US011495928B2

(12) United States Patent
Landwehr et al.

(10) Patent No.: US 11,495,928 B2
(45) Date of Patent: Nov. 8, 2022

(54) ELECTRONICALLY ACTUATED RETAINING LATCH FOR AC-DC ADAPTER REMOVABLE PLUG ASSEMBLY

(71) Applicant: NVIDIA Corporation, Santa Clara, CA (US)

(72) Inventors: Boris Landwehr, Thousand Oaks, CA (US); James Lee, San Jose, CA (US); Craig Crawford, Beaverton, OR (US); Andrew Bell, San Francisco, CA (US); Samuel Duell, Campbell, CA (US)

(73) Assignee: NVIDIA Corporation, Santa Clara, CA (US)

( * ) Notice: Subject to any disclaimer, the term of this patent is extended or adjusted under 35 U.S.C. 154(b) by 156 days.

(21) Appl. No.: 17/002,412

(22) Filed: Aug. 25, 2020

(65) Prior Publication Data

US 2021/0050697 A1 Feb. 18, 2021

Related U.S. Application Data

(62) Division of application No. 15/983,860, filed on May 18, 2018, now Pat. No. 10,790,628.

(51) Int. Cl.

| | |
|---|---|
| ***H01R 31/06*** | (2006.01) |
| ***H01R 13/62*** | (2006.01) |
| ***H01R 27/00*** | (2006.01) |

(52) U.S. Cl.

CPC ..... *H01R 31/06* (2013.01); *H01R 13/6205* (2013.01); *H01R 27/00* (2013.01)

(58) Field of Classification Search

CPC .. H01R 31/06; H01R 13/514; H01R 13/6205; H01R 27/00

USPC ..... 439/638, 345–347, 352, 593, 173, 489, 439/640, 650, 660

See application file for complete search history.

(56) References Cited

U.S. PATENT DOCUMENTS

| | | | | |
|---|---|---|---|---|
| 4,494,809 A * | 1/1985 | Soloman | H01R 31/06 439/651 |
| 5,613,863 A | 3/1997 | Klaus et al. | |
| 5,634,806 A * | 6/1997 | Hahn | H01R 27/00 439/172 |

(Continued)

FOREIGN PATENT DOCUMENTS

| | | |
|---|---|---|
| CN | 103863214 A | 6/2014 |
| CN | 104185930 A | 12/2014 |

(Continued)

OTHER PUBLICATIONS

Chinese Office Action issued in Chinese Application No. 201910419122.7 dated Nov. 22, 2021 with English translation (7 pages).

(Continued)

*Primary Examiner* — Marcus E Harcum
(74) *Attorney, Agent, or Firm* — Nixon & Vanderhye P.C.

(57) ABSTRACT

A power adapter has a solenoid actuated retaining latch controlled by an electronic circuit that detects the presence or absence of AC mains voltage. When the assembled AC-DC adapter and plug assembly are removed from the wall, the latch detects removal and unlocks the plug assembly for easy removal without undue force required by the user. The circuit is designed for minimal power consumption, and the solenoid only consumes power when it is engaging or disengaging the latch.

11 Claims, 14 Drawing Sheets

(56) References Cited

U.S. PATENT DOCUMENTS

| | | | | |
|---|---|---|---|---|
| 5,865,640 | A | 2/1999 | Tadokoro | |
| 5,973,948 | A | 10/1999 | Hahn et al. | |
| 6,790,070 | B1 | 9/2004 | England, II | |
| 7,601,023 | B1 * | 10/2009 | Ma | H01R 31/06 439/518 |
| 7,632,119 | B1 * | 12/2009 | Ma | H01R 31/06 439/333 |
| 7,798,825 | B1 * | 9/2010 | Pai | H01R 31/06 439/131 |
| 8,033,847 | B1 * | 10/2011 | Chen | H01R 29/00 439/172 |
| 8,388,352 | B1 | 3/2013 | Chong Yu et al. | |
| 8,465,307 | B2 * | 6/2013 | Shieh | H01R 31/06 439/173 |
| 8,469,730 | B2 * | 6/2013 | Garb | H01R 31/065 439/166 |
| 8,951,060 | B2 | 2/2015 | Meye-Ebeling | |
| 9,166,351 | B1 | 10/2015 | Wang et al. | |
| 9,543,702 | B2 | 1/2017 | Wu et al. | |
| 9,543,704 | B1 * | 1/2017 | Hsu | H01R 24/28 |
| 10,367,300 | B2 | 7/2019 | Shedletsky et al. | |
| 10,483,704 | B1 * | 11/2019 | Solland | H01R 29/00 |
| 10,601,194 | B1 * | 3/2020 | Chien | H01R 24/78 |
| 10,673,192 | B1 * | 6/2020 | Liu | H01R 31/06 |
| 10,862,238 | B2 * | 12/2020 | Hasan | H01R 13/502 |
| 2004/0147150 | A1 * | 7/2004 | Chen | H01R 31/06 439/176 |
| 2004/0235331 | A1 | 11/2004 | Rust et al. | |
| 2008/0150480 | A1 | 6/2008 | Navid | |
| 2009/0117765 | A1 | 5/2009 | Wen et al. | |
| 2009/0163080 | A1 * | 6/2009 | Peng | H01R 13/6273 439/628 |
| 2010/0120274 | A1 * | 5/2010 | Arenas | H01R 9/2491 29/428 |
| 2010/0255698 | A1 | 10/2010 | Chen | |
| 2010/0317215 | A1 | 12/2010 | Chang | |
| 2011/0039435 | A1 | 2/2011 | Huang | |
| 2011/0053404 | A1 * | 3/2011 | Tsuruta | H01R 13/4365 439/345 |
| 2011/0117766 | A1 * | 5/2011 | Chen | H01R 24/28 439/518 |
| 2011/0201223 | A1 * | 8/2011 | Kurumizawa | B60L 50/61 439/345 |
| 2011/0210699 | A1 | 9/2011 | Wu | |
| 2012/0214348 | A1 | 8/2012 | Youssefi-Shams et al. | |
| 2013/0260595 | A1 | 10/2013 | Tamaki et al. | |
| 2014/0073153 | A1 * | 3/2014 | Pai | H01R 13/71 439/131 |
| 2014/0170890 | A1 | 6/2014 | Kurumizawa | |
| 2015/0364866 | A1 * | 12/2015 | Gagne | H01R 13/635 439/159 |
| 2016/0056600 | A1 * | 2/2016 | Liao | H01R 35/04 439/131 |
| 2019/0207349 | A1 * | 7/2019 | Yuan | H01R 13/631 |
| 2019/0312395 | A1 * | 10/2019 | Barnett | H01R 31/06 |
| 2021/0218205 | A1 * | 7/2021 | Zhang | H01R 27/00 |
| 2021/0384686 | A1 * | 12/2021 | Choi | H01R 24/30 |

FOREIGN PATENT DOCUMENTS

| | | | |
|---|---|---|---|
| EP | 2453276 | A1 | 5/2012 |
| EP | 3089279 | A1 | 11/2016 |
| WO | 2011/071170 | A1 | 6/2011 |

OTHER PUBLICATIONS

Chinese Office Action issued in Chinese Application No. 201910419122.7 dated Apr. 8, 2022 with English translation (21 pages).

Chinese Patent Office Search in Chinese Application No. 201910419122.7 dated Mar. 31, 2022 with English translation (2 pages).

* cited by examiner

ELECTRONICALLY ACTUATED RETAINING LATCH FOR AC-DC ADAPTER REMOVABLE PLUG ASSEMBLY

CROSS-REFERENCE TO RELATED APPLICATIONS

This application is a divisional of U.S. patent application Ser. No. 15/983,860, filed May 18, 2018, and incorporated herein by reference.

STATEMENT REGARDING FEDERALLY SPONSORED RESEARCH OR DEVELOPMENT

None.

FIELD

The example technology herein relates to international power adapters, and more particularly to power devices that can be reconfigured for different power mains socket types.

BACKGROUND & SUMMARY

While the world long ago agreed on alternating (not direct) current (AC) for electrical "mains" (household) power delivery, there is no worldwide standardization on the configuration of AC connecting plugs or even AC voltages and frequencies. North America generally uses 110 VAC at 60 Hz, Japan uses 100 VAC at 50 or 60 Hz (depending on which part of the country you are in) and most of Europe uses 230 VAC at 50 Hz. Moreover, there are at least twelve different types of AC electrical plugs in widespread use throughout the world. North America and Japan settled on Types A (two-prong ungrounded) and B (three-prong grounded), whereas most of South America, Africa, Europe and Asia use Type C. Parts of Africa and parts of Asia use Type D, a smattering of countries in Europe, Asia and Africa use Types E, F, G and H, Australia and some businesses in Japan use Type I, Liechtenstein uses type J, and so on. None of these are compatible with one another, requiring worldwide travelers to bring along plug adapters to enable them to plug their AC devices into AC mains outlets of different countries. See www.trade.gov/mas/ian/ECW/characteristics.html.

Many modern digital appliances such as computers, tablets, smart phones and the like operate at voltages lower than the power mains, such as 5 VDC or 12 VDC. Such appliances often employ an external "power adapter" (step-down transformer or other circuit) to step the AC mains line voltage down to the particular lower voltage the appliance requires. Some such power adapters rectify the stepped-down voltage to convert alternating current from the power mains to direct current. These power adapters are often called "AC-DC power adapters."

To accommodate these various different worldwide power conventions, it is common practice to design such AC-DC power adapters with removable plug assemblies. This is beneficial to the manufacturer because it enables a single power adapter to be sold globally by shipping it with the specific plug assemblies required for each particular region. In some cases, the manufacturer provides several different interchangeable removable plug assemblies to the end user so the end user can use the same adapter in different global regions just by swapping between interchangeable plug assemblies. Users benefit by having a means of making the adapter compatible with different types of receptacles while traveling.

Some such interchangeable plug assemblies rely either on friction or a mechanical latch to retain the plug assembly in the body of the main adapter. These retaining systems can be confusing to the user, because without instructions printed on the device, it is not always clear which direction to pull or how much force to apply to the latch in order to disengage the plug assembly from the adapter body.

As a separate problem, AC-DC adapters which have the orientation of the AC prongs fixed relative to the adapter body will inevitably block an adjacent AC mains outlet depending on orientation of adjacent outlets in a power strip or wall socket. Some earlier solutions provided for rotation of the AC mains blades, but in such solutions the rotating blade mechanism is generally not detachable from the AC adapter body.

Further improvements are possible.

BRIEF DESCRIPTION OF THE DRAWINGS

The following detailed description of exemplary non-limiting illustrative embodiments is to be read in conjunction with the drawings of which.

DETAILED DESCRIPTION OF NON-LIMITING EXAMPLE EMBODIMENTS

Figure 1:
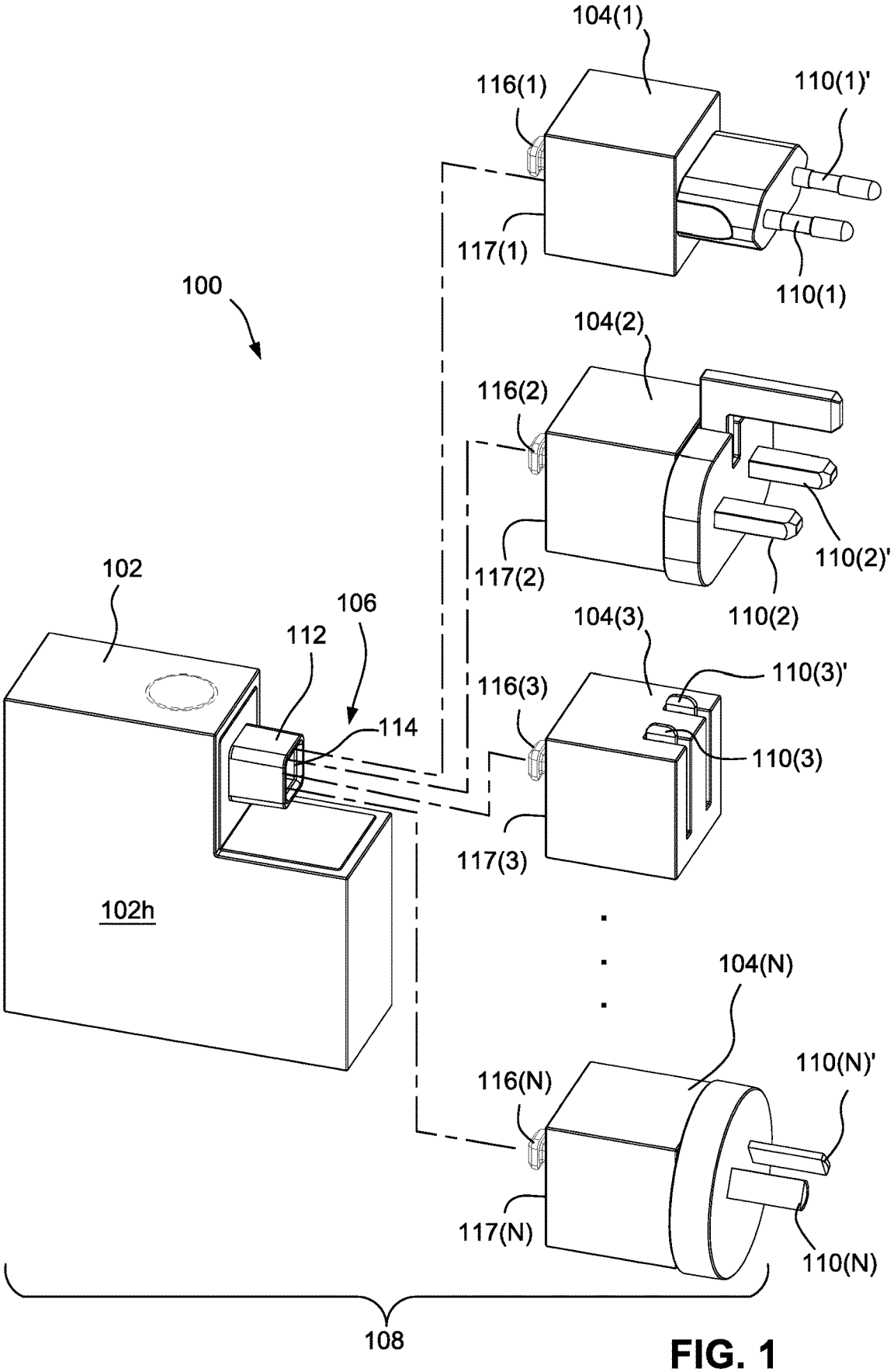
FIG. 1 is an elevated side perspective view of an example non-limiting AC-to-DC adapter kit.

Example non-limiting embodiments herein replace the mechanically actuated retaining latch of a power adapter with a solenoid-actuated retaining latch. This solenoid is controlled by an electronic circuit that detects the presence or absence of the AC mains voltage. When the assembled AC-DC adapter and plug assembly are removed from the wall socket, the latch detects removal and unlocks the plug assembly for easy removal without undue force required by the user. The circuit is designed for minimal power consumption, and the solenoid consumes power only when it is engaging or disengaging the latch.

With such example non-limiting embodiments, it is possible to design the plug assembly such that it is held temporarily to the main AC-DC adapter body with a light and precise force. This light force could be implemented with permanent magnets or some other material that would provide the desired feel to the user. Once the unit is inserted into the wall, the electromagnetic latch engages with the necessary force required by the user to insert the plug assembly from the force required by the power adapter to retain it. In other words, some example non-limiting embodiments decouple the force required by the user to insert the plug assembly from the force required by the power adapter to retain it. The user experience of the insertion and extraction of the plug assembly can then be independently customizable. This enables a novel user experience.

Other aspects of disclosed non-limiting embodiments address the problem of blocked outlets by providing a detachable regional adapter which be installed in multiple orientations to prevent the body of the adapter from blocking adjacent outlets. Novel aspects include the shape and orientation of the electrical contacts between the regional adapter and the main AC adapter body, which allow for multiple orientations while still meeting international safety standards. The latching mechanism safely holds the regional adapter to the AC adapter body, and the magnetic alignment features aid in user installation of the regional adapter.

Such example non-limiting embodiments provide the ability install the regional adapter in multiple orientations relative to the AC adapter body. This provides streamlined logistics for international distribution by separating the regional differentiating features from the common features of the adapter.

Additional example non-limiting features and advantages include:

- Clip inside to provide a "Click" feel while prong folding
- Terminal feature made to be flexible to smoothly contact with prongs
- Latch Pin reinforced (e.g., with a reinforcing steel or other rigid pin inserted into the tool and co-molded within the Latch Pin) so that it can withstand abuse without breaking
- part/assembly tolerances (e.g., the distance from the bottom of the assembly to the pin/latch contact point, and the distance from the top of the Adapter Face to the pin/latch contact point) controlled for solid latching experience
- Pin/Latch tolerance loop shortened e.g., by merging latch pin and associated face
- Bottom face of assembly provides the required point of adapter contact to limit the tolerances that impact the Pin<->latch connection (e.g., the outer cover frame face is the datum for contact; Target=PIN/FACE will be USW to DH held flush cover to 0.10 proud of the Cover lip; the Outer Cover Frame is not the first point of contact no matter how the user tries to make the coupling)
- Merging of the latch pin and the face, and using the bottom face to locate means the outer cover will only contact the plastic face of adapter along one edge; a single critical tolerance is controlled to assure good latching; the bottom face is the only point of contact on all four sides since locating on both the Face and the Cover could result in tilt and create a gap; the cover will not contact the adapter face on three sides (on the other 3 sides the face controls contact).
- Design of the Adapter Face assembly controls the tolerance and assembly loop to assure good Pin<->Latch connection.

Example Non-Limiting Adapter Kit 100

FIG. 1 shows an example non-limiting kit 100 useful for adapting a power mains to an electrical or electronic appliance. In the example shown, kit 100 comprises an adapter base 102 and a plurality of interchangeable plug connectors 104(1), 104(2) . . . 104(N). In the non-limiting example shown, kit 100 includes the following components:

- a Type C plug connector 104(1) (which can be used in most of continental Europe, Asia, South America and Africa);
- a Type G plug connector 104(2) (which can be used in China, India, the United Kingdom, parts of Africa and South America, and parts of Southeast Asia);
- a Type A plug connector 104(3) (which can be used in the United States, Japan, central America, parts of South America, parts of Africa, and parts of Southeast Asia);
- an ungrounded Type H plug connector 104(N) (which can be used in China, parts of Africa, parts of Central and South America; and
- the adapter base 102.

Power prongs 104 are interchangeably connectable to the adapter base 102—one at a time—to assemble any number of differently-configured integrated adapters 108. The kit 100 can contain any number of plug connectors 104 (that is, "N" can be any positive integer). The plug Types shown are exemplary. Any plug Type is possible.

Plug connectors 104 have extending power prongs 110 that are used to electrically connect to power mains. These power prongs 110 are typically made of a conductive metal such as brass or nickel-plated brass. The power prongs conduct AC voltage and current from the power mains to the adapter base 102 when the power prongs are inserted into corresponding female socket portions of the power mains. The number of power prongs 110 depend on the Type of female socket they are designed to be compatible with. There will typically be at least two (2) prongs 110 on each plug connector 104 (two AC lines), and some plug connectors (e.g., plug connector 104(2) have three prongs (two line voltages and one ground).

In the non-limiting examples shown, each of plug connectors 104 provides a male plug configured to mate with a female mains power socket (generally, mains power sockets are female so that there is no protruding portion that could be accidentally contacted to deliver an electric shock). However, other configurations are possible. For example, in low voltage applications where the risk of shock is reduced or eliminated, the interchangeable plug connectors 104 could be female sockets or have both male portions and female portions.

To use kit 100, the user selects one of plug connectors 104 (this selection is typically made based on the type of power mains socket or other connector the user wants to connect to). The user then mates the selected plug connector 104 with the adapter base 102 to form an integrated power adapter 108. When the user wishes to make the adapter 108 compatible with a different type of power mains socket or other connector, the user removes the plug connector 104 currently mated with the adapter base 102 and replaces it with a different plug connector 104 selected to be compatible with the different power mains socket type. Thus, any one of plug connectors 104 can be removably, physically and electrically connected to the adapter base 104 to form an integrated adapter compatible with a certain power mains configuration (see FIGS. 2A, 2B for the example where plug connector 104(3) is connected to the adapter portion). The adapter base 102 can be reused with different plug connectors 104 to provide a differently-configured integrated adapter 108 that is compatible with differently-configured power mains.

As will be explained in more detail below, the example non-limiting embodiments provide improvements so that adapter base 102 automatically firmly retains the selected plug connector 104 so long as the integrated adapter 108 is plugged into the power mains yet allows the user to easily remove and replace plug connectors from/to the adapter base when the adapter is unconnected from the power mains.

Adapter Base Housing Shape

Figure 2A:
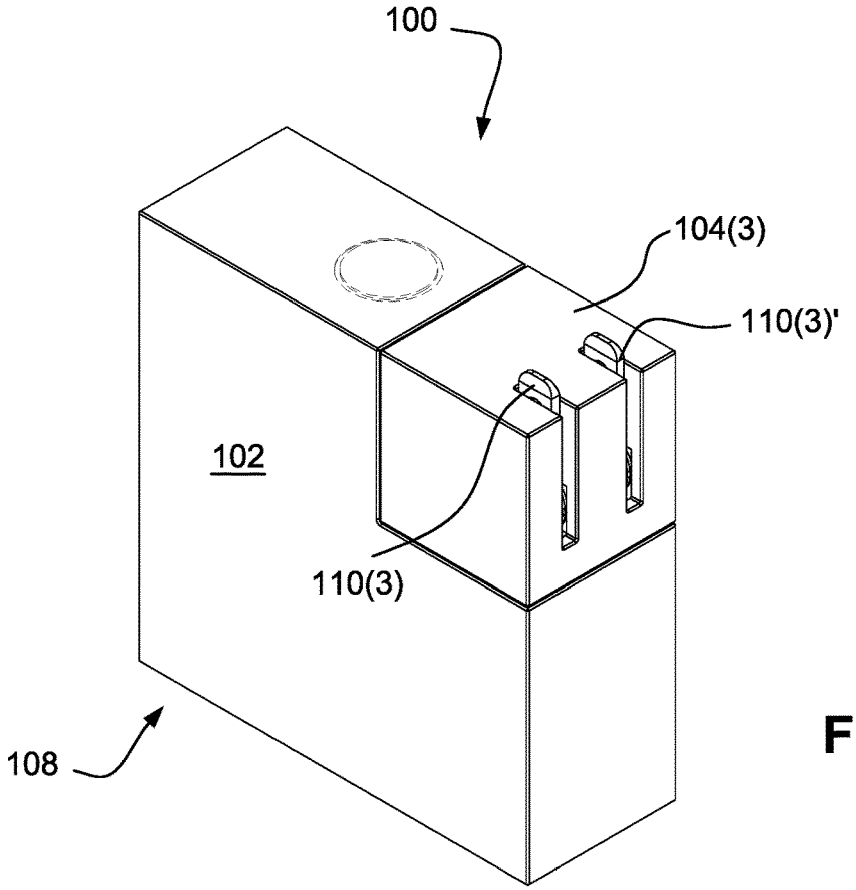
FIGS. 2A and 2B are side elevated perspective views of a non-limiting example of the FIG. 1 kit configured to provide a plug or male portion that is compatible with North American Type A power mains.
Figure 2B:
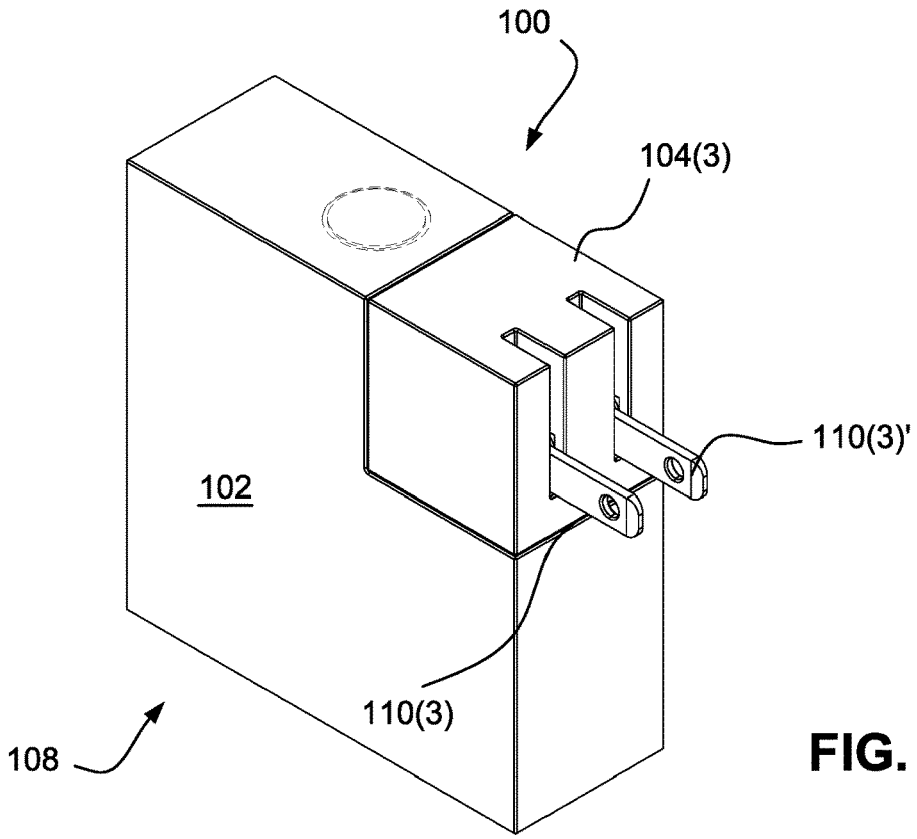

In the particular non-limiting example shown, the adapter base 104 is generally rectangular with a cutout 106 dimensioned and shaped to physically accommodate (one at a time) each of plug connectors 104. In particular, the plug connectors 104 each are shaped to fit into the cutout 106 of adapter 102 so that when a given plug connector 104 is physically mated with the adapter base 102, the plug connector conforms with the shape of the adapter base 102 and the resulting assembled adapter 108 form factor (as shown in FIGS. 2A, 2B) resembles an integral whole (e.g., a rectangular or cubic block) with no extending portions other than power prongs 110. As can be seen in FIGS. 2A and 2B, some power prongs 110, 110' can be retractable between a retracted position (FIG. 2A) and an extended position (FIG. 2B) so that the prongs can be retracted when not in use to make the integrated adapter 108 more compact for storage and more aesthetically pleasing. Shapes such as rectangular and cubic for the integrated adapter 108 are non-limiting. Any desired shape is possible including for example D-shaped, circular, oblong, spherical, rod-shaped or any other desired shape.

Removably Latching Interchangeable Plug Connectors Into Adapter Base

FIG. 1 shows that adapter base 102 includes, positioned within cutout portion 106, a protruding latching receptacle 112 including a recess 114 dimensioned, shaped and configured to accept and retain a latch pin 116 extending from a(ny) plug connector 104. In the non-limiting example shown, every plug connector 104 has a similarly-configured or identically-configured latch pin 116 so that each or any plug connector latching receptacle 112 can mate with the common adapter base 102. In the example shown, the adapter base protruding latching receptacle 112 is capable of selectively firmly retaining/latching a latch pin 116 and selectively fixedly mechanically and electrically attaching/connecting the associated plug connector 104 to the adapter base 102.

Latching In Multiple Different Orientations

Figure 3A:
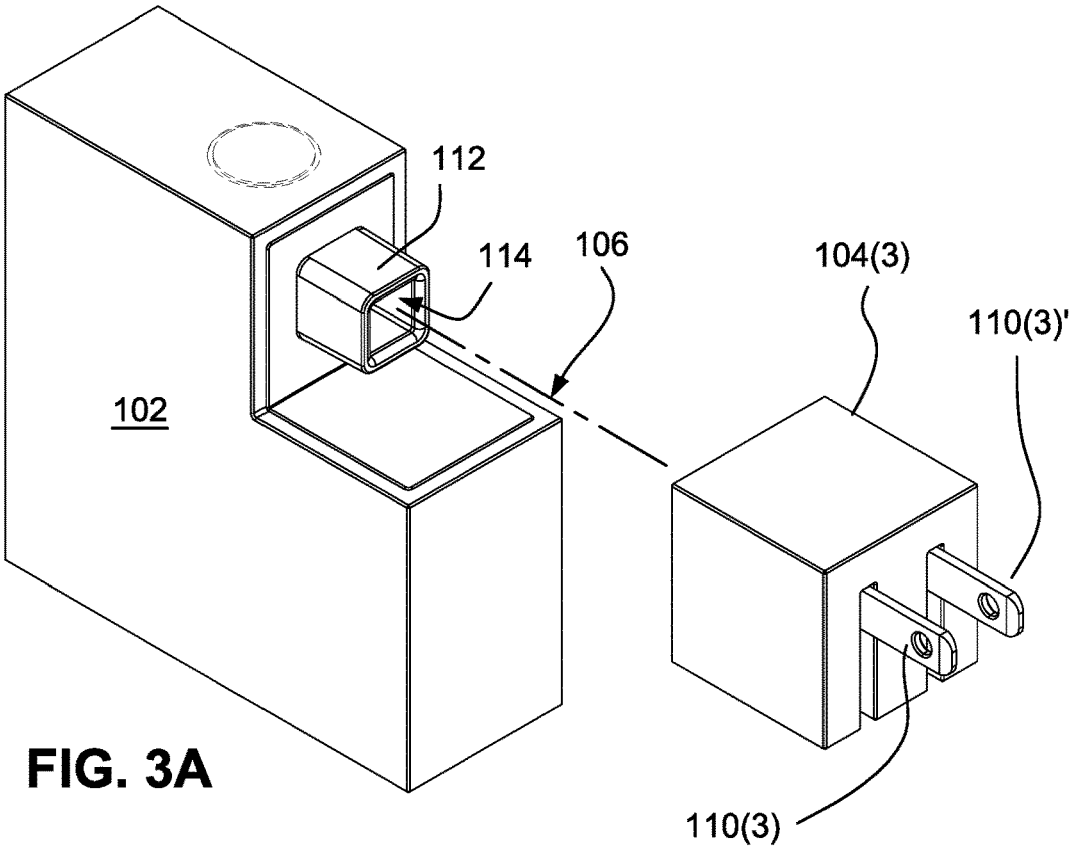
FIGS. 3A and 3B are side elevated exploded perspective views showing how the FIG. 1 kit can be configured for different orientations of the plug connector relative to the adapter base housing.
Figure 3B:
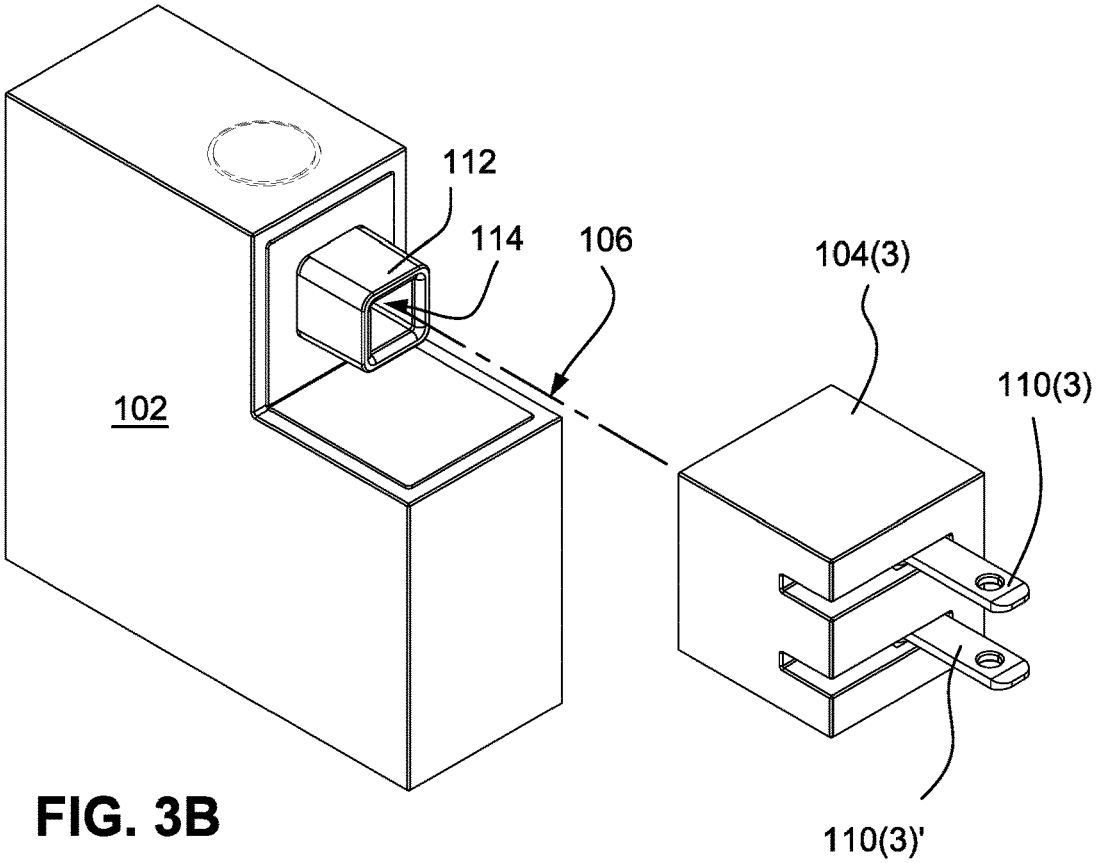

In example non-limiting embodiments, latching pin 116 is symmetrical such that it can mate with latching receptacle 112 in any of plural different relative orientations. For example, in some non-limiting embodiments, the latching pin 116 can successfully mate with latching receptacle 114 at relative rotational orientations of 0°, 90°, 180° and 270°. Furthermore, the latching pin 116 is centered onto a rear mating surface 117 of plug connector 104 so the latching pin is insertable into and latchable by latching receptacle 112 when plug connector 104 is rotated to different rotational orientations relative to the adapter base 102. As FIGS. 3A and 3B show, this provides a variety of choices for the orientation (and in some case the positions) of power prongs 110 relative to adapter base 102. This feature enables the user to choose an optimal orientation for the power prongs 110 to prevent the joined adapter base 102 from physically interfering with adjacent female sockets or other devices, plugs plugged into such adjacent female sockets, etc. This variable orientation feature is for example particularly useful when using the integrated adapter 108 with an electrical power strip having many closely-spaced sockets connected to other devices.

Electrical Connectivity In Multiple Different Orientations

The recess 114 of protruding latching receptacle 112 includes internal electrical conductors that electrically connect with electrical conductors within the latch pins 116 to electrically connect the plug connector power prongs 110 to internal electrical components within adapter base 102. The latching receptacle 112 contains a sufficient number of electrical conductors needed to connect with the plug connector(s) 104. In some example embodiments, all of plug connectors 104 have the same number of power prongs 110 (e.g., two prongs) and latching receptacle 112 and latching pin 116 each provide this same number of isolated (non-shorting) electrical connections when they are mated. In other non-limiting configurations, latching receptacle 112 may have one or more electrical connectors that will be unused when connected to certain plug connectors 104 but used when connected to certain other plug connectors.

Electromagnetic Latching Mechanism

As will be detailed below, an electromagnetic latching mechanism within adapter base 102 is used to selectively firmly retain latching pin 116 within latching receptacle 112 when power is applied to the integrated adapter 108 via power prongs 110. Thus, in these non-limiting examples, power applied to power prongs 110 flows through the plug connector 104 and through the interconnected latching pin 116 and latching receptacle 112 into adapter base 102. This power applied to the adapter base 102 causes the adapter base to activate an internal electromagnetic latch that latches the latching pin 116 into the latching receptacle 112. When power ceases flowing through the power prongs 110 to the latching base 102, the latching base unlatches the internal electromagnetic latch to release the latching pin 116 from the latching receptacle 112.

In other embodiments, a spring-biased mechanical latching mechanism is used to latch the latching pin 116 into the latching receptacle 112, and a push button (shown in phantom) is used to release the latching mechanism. While the mechanical latching mechanism (as described above) is simple and cost-effective, advantages can be obtained by using an electromagnetic latching mechanism instead of or in conjunction with the mechanical latching mechanism.

Figure 4:
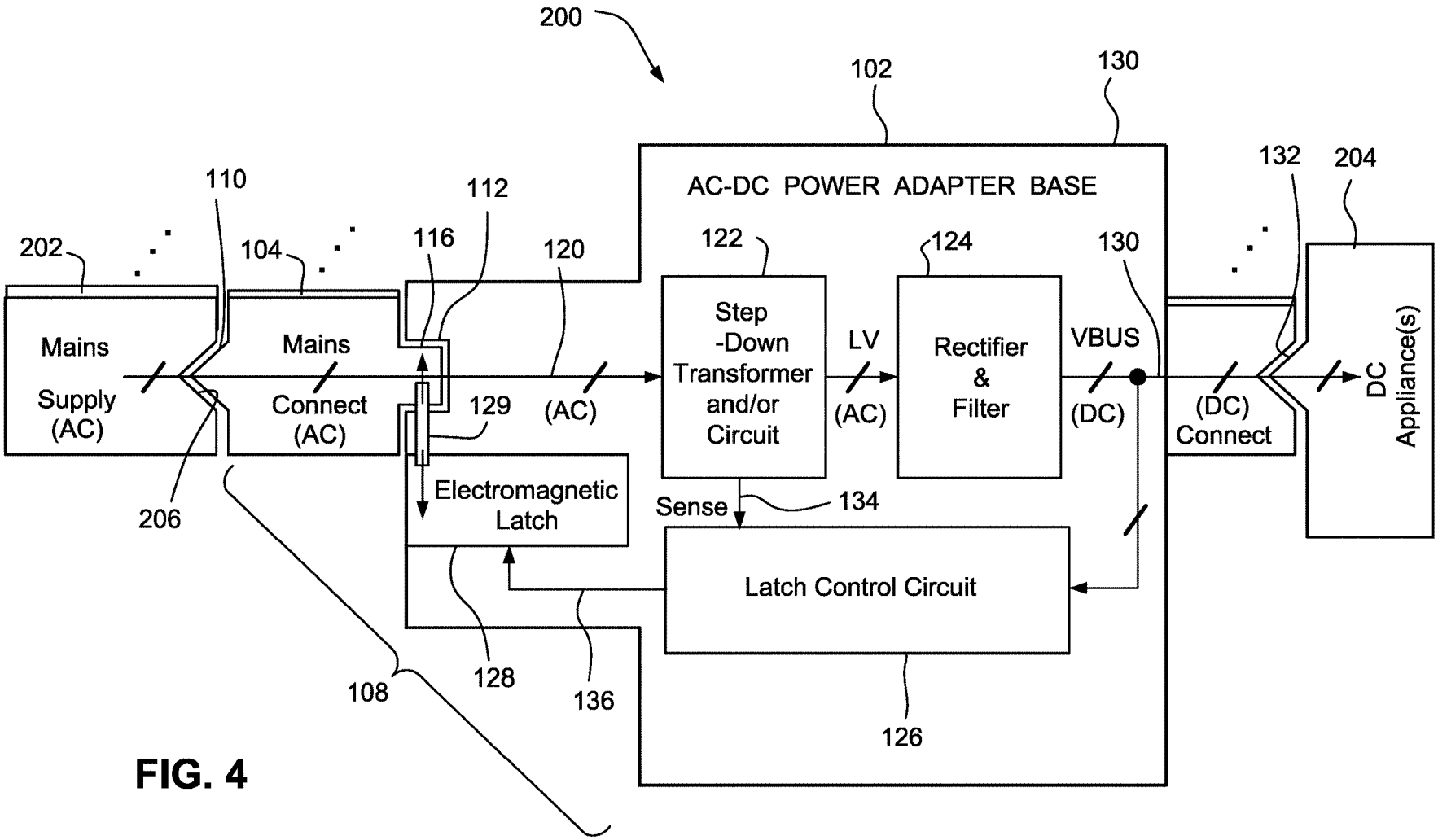
FIG. 4 shows an example conceptual block diagram of an overall non-limiting AC-to-DC power conversion system including the FIG. 1 kit.

Conceptual Block Diagram of Overall System Including Electromagnetic Latching Mechanism FIG. 4 is a conceptual block diagram of an overall system that uses the integrated adapter 108 to connect power mains 202 to one or more appliances 204. In this particular non-limiting example, power mains 202 supplies alternating current (AC) at for example, 100 VAC, 110 VAC, 220 VAC, etc., and appliance 204 requires a direct current (DC) at a lower voltage such as 5 VDC, 9 VDC, or 12 VDC. The integrated adapter 108 thus provides an AC-to-DC conversion as well as a voltage stepdown or transformation. However, the principles described herein could be used for supplying AC current from the power mains to an AC appliance or for supplying DC current from the power mains to a DC appliance (no AC-to-DC conversion). Similarly, the principles described herein could be used with or without a voltage stepdown. Nevertheless, a preferred embodiment provides both stepdown and AC-to-DC conversion to allow a lower voltage DC appliance 204 such as a personal computer, a handheld computing device or other digital appliance to be powered from higher voltage AC power mains 202.

In the non-limiting example shown in FIG. 4, plug connector 104 (shown conceptually rather than structurally) is used as a mains connector to connect to the mains supply 202. The plug prongs 110 are abstractly shown interfacing with mating sockets 206 of mains supply 202. The plug connector 104 in turn mechanically and electrically connects to adapter base 102 via the latching pin 116 which is inserted into and latched by latching receptacle 112. In this way, the power supplied by mains supply 202 is supplied to conductors 120 within adapter base 102.

Adapter base 102 includes a housing 130 containing a stepdown transformer and/or circuit 122, a rectifier 124, a latch control circuit 126 and an electromagnetic latch 128. In the example shown, the stepdown transformer or circuit steps down or transforms the AC voltage from the power mains 202 to a lower voltage. Such stepdown transformer (inductive or solid state e.g., thyristor-based using silicon controlled rectifiers) circuits are well known in the art. The transformer 122 in the example shown can operate at a variety of different primary voltages such as 100 VAC, 110 VAC, 220 VAC, etc., and frequencies such as 50 Hz or 60 Hz.

The resulting stepped-down voltage (LV) is rectified and filtered by rectifier/filter 124 to output filtered DC voltage onto a voltage bus (VBUS) 130. The voltage bus 130 is connected to the appliance 204 either directly or through another connector(s) 132 such as USB, barrel connector or any other convenient DC interconnect.

The VBUS 130 is also provided to power a latch control circuit 126. In the example non-limiting embodiment, the latch control circuit 126 also receives a sense input 134 from step-down transformer 122. The sense input 134 indicates when power from the power mains 202 is applied to or removed from adapter base 102.

In response to the sense input 134, the latch control circuit 126 selectively applies a latching signal or a delatching signal to electromagnetic latch 128 via control line 136. Specifically, latch control circuit 126 applies a latching signal to electromagnetic latch 128 via line 136 when the sense input 134 indicates that AC power from the power mains 202 is applied to the adapter base 102, and applies a delatching signal to the magnetic line via line 136 when the sense input indicates that AC power has been disconnected and is no longer present. The electromagnetic latch 128 and associated mechanical latching mechanism moves to (or stays in) the latched position/state so long as the latching signal is present, and moves to (or stays in) the delatched position/stage so long as the delatching signal is present. The latched or delatched state of electromagnetic latch 128 and associated mechanical latching mechanism in turn selectively latch the latching pin 116 into or release the latching pin from the latching receptacle 112.

Example Non-Limiting Latch Control Circuit

Figure 5:
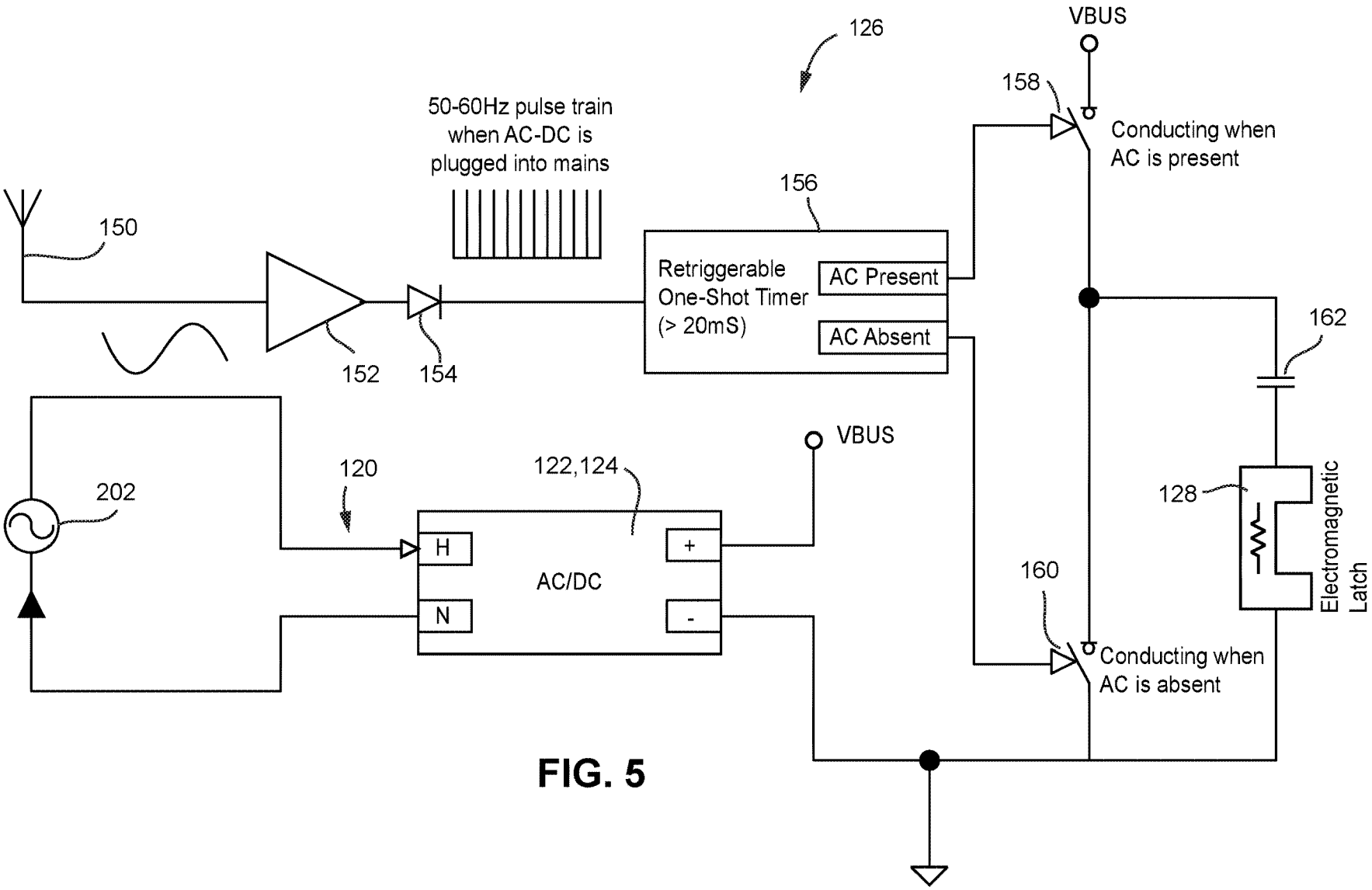
FIG. 5 is a schematic circuit diagram of a non-limiting latch control circuit controlling an electromagnetic latch.

In the particular example embodiment of latch control circuit 126 shown in FIG. 5, a pickup 150 electromagnetically coupled to the power mains conductor 120 picks up a low amplitude version of the incoming power mains 202 AC signal. In the example shown, the pickup 150 can comprise a short conductor operating as an antenna that is electrically insulated from but runs parallel to a length of the power mains conductor 120. Other embodiments could use a small, electrically-isolated but electromagnetically-coupled sympathetic winding of stepdown transformer 122 or other arrangements as a pickup 150.

The low amplitude version of the incoming power mains signal outputted by pickup 150 is applied to a detector comprising a comparator 152 and a diode 154. The combination of comparator 152 and diode 154 operate as a clipper to produce an output pulse each time the AC signal provided by pickup 150 exceeds a certain positive (or negative) threshold voltage. The resulting frequency detection produces a pulse for each cycle of the incoming AC mains pickup signal. Many other sensing circuits such as polarity or frequency detector could be used since the objective is to determine whether the AC mains signal continues to be present.

The output of diode 154 comprises a pulse train having a repetition rate equal or proportional to the frequency of AC signal supplied by the power mains 202. That is, if the power mains 202 supplies an AC power signal of 50-60 Hz, the output of diode 154 will be a 50-60 Hz pulse train (or some multiple thereof) whenever the integrated adapter 108 is plugged into the power mains 202.

The repetitive pulse train is applied to the input of a retriggerable one-shot timer 156. The one-shot timer 156 has two mutually-exclusive output states: "AC present" and "AC absent." The one-shot timer 156 begins generating an "AC present" output signal when it begins receiving pulses from diode 154, and will continuously generate this "AC present" signal so long as diode 154 continues to produce pulses indicating that the power mains signal is still being applied to the adapter base 102. The time constant of the one-shot timer 156 is set to greater than 20 milliseconds so it will continue to produce the "AC present" signal so long as the next pulse derived from pickup 150 arrives within a time window indicative of an at least 50 Hz periodic signal (1/50 Hz=0.02 seconds=20 milliseconds).

Upon discontinuance of pulses from the diode 154, the one-shot timer 156 resets, ceases to produce the "AC present" output and instead begins producing the "AC absent" output. The one-shot timer 156 will continue to produce the "AC absent" output until it again begins receiving pulses from diode 154 indicating the AC power from power mains 202 has been restored, at which point it will cease producing "AC absent" and instead begin producing "AC present".

The "AC present" output of one-shot timer 156 is connected to control closing of a first switch 158, and the "AC absent" output of the one-shot timer is connected to control closing of a second switch 160. Because these two one-shot timer 156 outputs are mutually exclusive, the first and second switches 158, 160 are never closed at the same time. Rather, only one of these two switches 158, 160 is closed at any given time depending on the state of one-shot timer 126. A dead time circuit (not shown) ensures that both switches 158, 160 are never closed at the same time, but rather that one has opened completely before the other begins to close and vice versa. [The dead circuit provides sufficient delay in some embodiments so that switch 160 does not close immediately upon a user suddenly pulling the integrated adapter 108 out of a power socket, thereby keeping adapter 108 integrated for a short while as the user pulls out the adapter.]

When the one-shot timer 156 first begins receiving the repetitive pulse train from diode 154 indicating that the adapter base 102 is connected to the power mains, it produces the "AC present" output that closes switch 158. Closing switch 158 connects the VBUS DC power across a series circuit consisting of an electromagnetic latch (solenoid) 128 connected in series with a capacitor 162. Closing switch 158 causes current to flow through electromagnetic latch 128 in a first polarity while capacitor 162 charges. This current flow causes the electromagnetic latch 128 to generate a magnetic field in a first direction. Once the capacitor 162 completely charges, only leakage current flows through the electromagnetic latch.

In one example non-limiting embodiment, electromagnetic latch 128 comprises a solenoid, i.e., a helically wound coil. Inside the coil is a movable permanent magnet armature 129. The armature 129 moves when DC current is applied to the solenoid. The direction in which the armature 129 moves depends on the polarity of the DC current applied to the solenoid. In the particular example shown, the permanent magnet armature 129 is pushed in one direction by a solenoid-produced magnetic field of a first direction, and is pushed in the opposite direction by a solenoid-produced magnetic field in a second direction opposite the first direction. When DC current of a first polarity is applied, the armature 129 moves in a first direction relative to the coil. When DC current of a second polarity opposite to the first polarity is applied, the armature 129 moves in a second direction relative to the coil opposite the first direction.

When closing of switch 158 causes DC current flow through electromagnetic latch in a first polarity, the armature 129 moves in a first direction which pushes a mechanical latching mechanism into a position that latches the latching pin 116 into latching receptacle 112. Once the capacitor 162 is fully charged, almost no current continues to flow through the series-connected capacitor and the electromagnetic latch 128. The only current draw is leakage current, which is very small. Thus, so long as the one-shot timer continues to receive input pulses from diode 154 indicating the power mains 202 connection is still present, capacitor 162 remains charged and the electromagnetic latch 128 remains in its latched state.

When power from power mains 202 is removed from adapter base 102 by for example unplugging the plug connector 104 from the power mains 202, components 152, 154 detect this and control the one-shot 156 to change state. The "AC present" output of one-shot 156 becomes inactive and its "AC absent" output becomes active. This state change causes switch 158 to open and switch 160 to close. Closing switch 160 has the effect of discharging the series-connected (charged) capacitor 162 across the electromagnetic latch 128. This discharging of capacitor 162 across latch 128 causes current to flow through the latch 128 in a reverse polarity as compared to the direction of current flow when switch 158 was closed in response to the "AC present" output of one-shot timer 156. The reverse current flow causes the electromagnetic latch 128 to generate a reverse polarity magnetic field. The capacitance of capacitor 162 is selected to have sufficient current-storage capacity to not only cause the magnetic field of electromagnetic latch 128 to collapse, but to also generate a reverse magnetic field of sufficient power and duration to cause the permanent magnet armature 129 to move from the latched position to the unlatched position. For example, capacitor 162 may comprise an electrolytic or other suitable large valued capacitor to provide current discharge of sufficient duration to cause the permanent magnet armature 129 to move to the unlatched position. Moving the armature 129 to the unlatched position releases latching pin 116 from latching receptacle 112, allowing the user to remove the latching pin from the latching recess 114.

In some non-limiting embodiments, additional mechanisms such as rare earth or other magnets M may be used to attract the plug connector 104 to adapter base 102 even when the electromagnetic latch 128 is unlatched, providing a weak (easy to overcome) attraction force that keeps integrated adapter 108 integrated while still allowing a user to easily pull plug connector 104 away from adapter base 102 so the user can replace the plug connector with another plug connector of a different configuration.

Example Non-Limiting Mechanical Structure of Adapter Base 102

Figure 6:
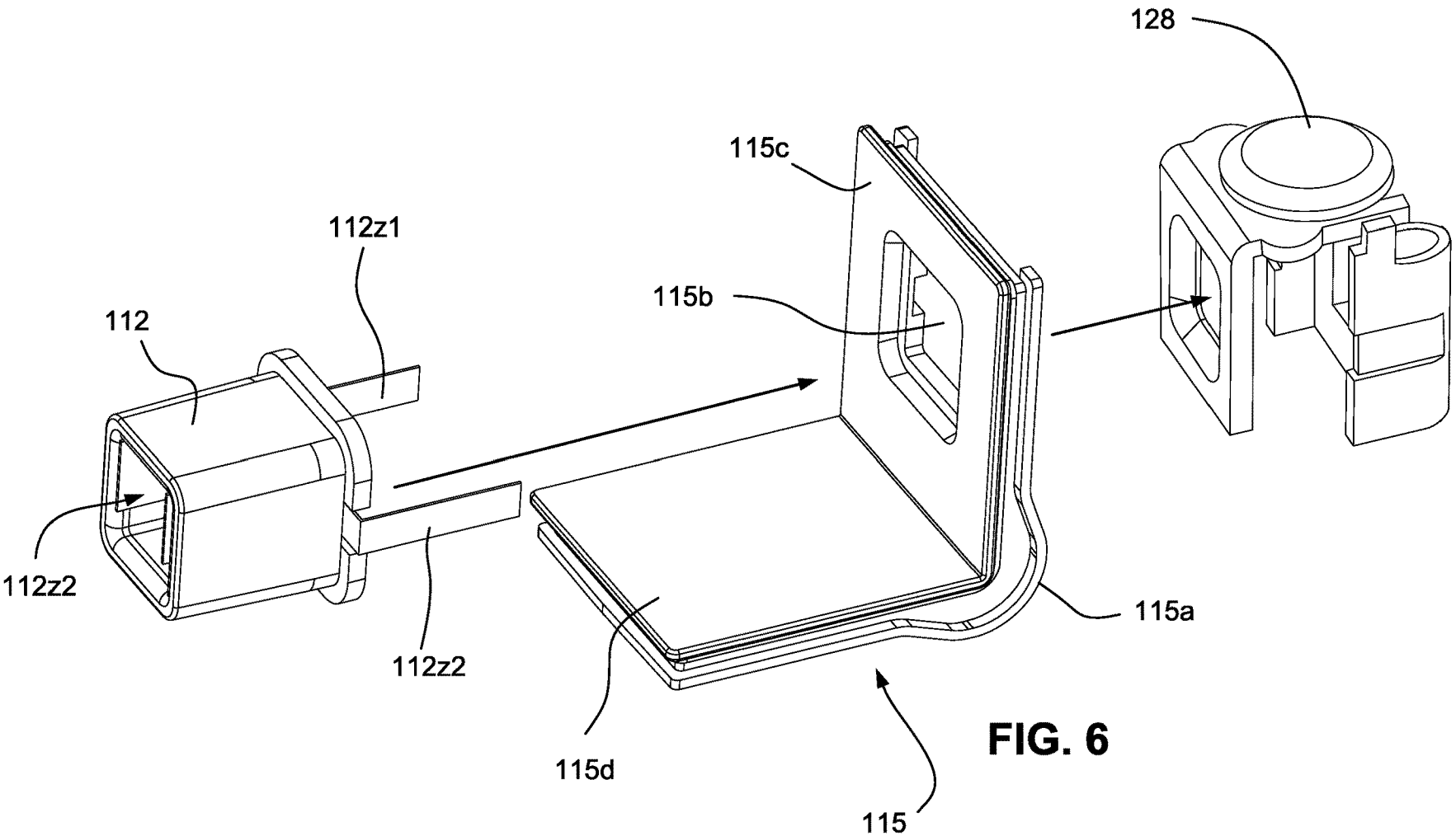
FIG. 6 is an exploded side elevated perspective exploded view of an example non-limiting adapter base latching receptacle including an electromagnetic latch assembly.
Figure 6A:
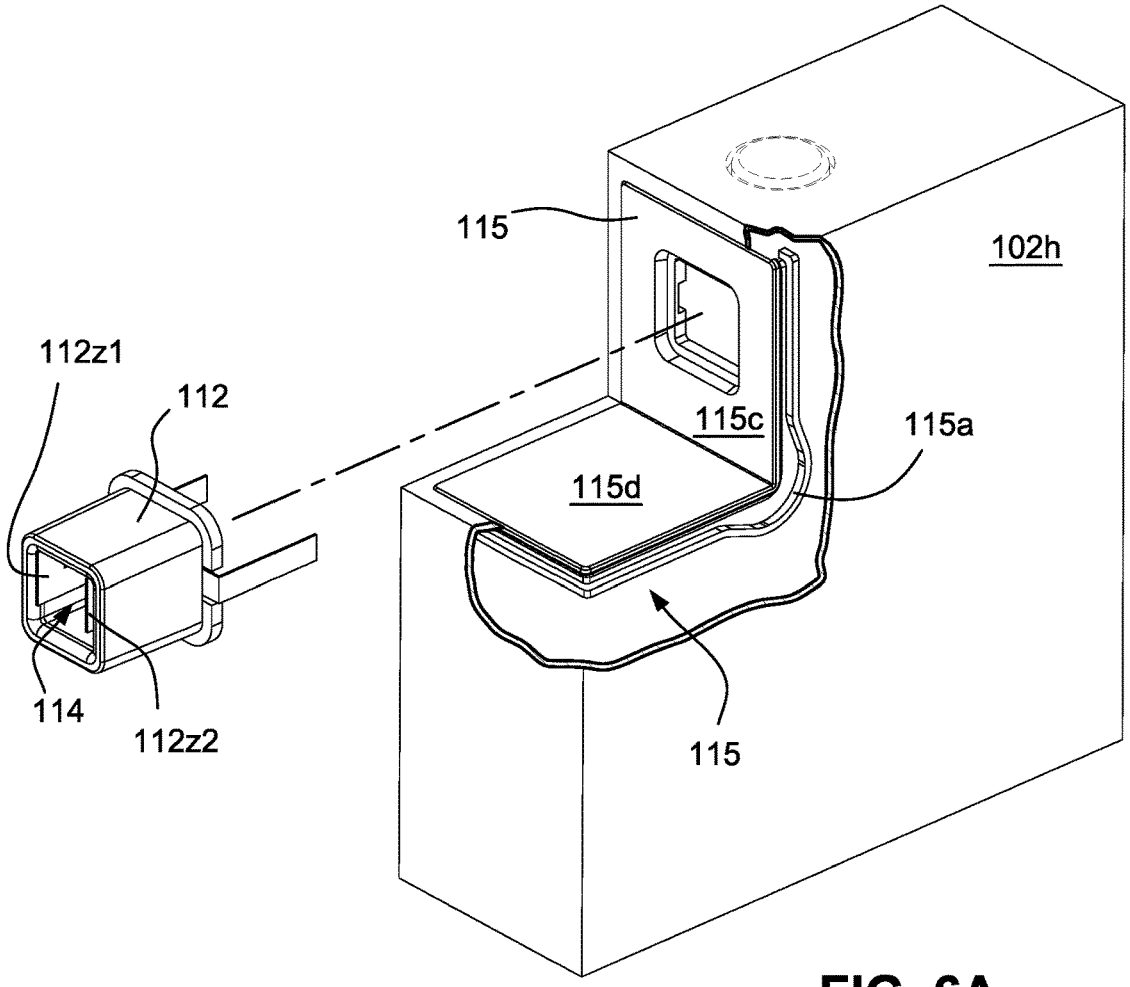
FIG. 6A shows a side elevated cutaway and perspective exploded view of an example non-limiting adapter base latching receptacle including an electromagnetic latch assembly.

FIGS. 6 and 6A show exploded views of an example adapter base latching receptacle 112 and its relationship to electromagnetic latch 128. In the example shown, the latching receptacle 112 is inserted into a beveled window 115*b* within a faceplate 115*c* that in turn is held in position in the adapter base 102 by a spring-loaded frame 115*a*. A latching mechanism 128 operates to latch and release a latching pin 116 that is inserted into the latching receptacle 112. The unlatching mechanism 128 could be a push button operated mechanical device as shown but preferably is an electromagnetic latch as described above (in cases that use the electromagnetic latch, no push button operated release mechanism is required and the mechanical latching device is replaced by an electromagnetic latch).

Example Latching Details

Figure 7:
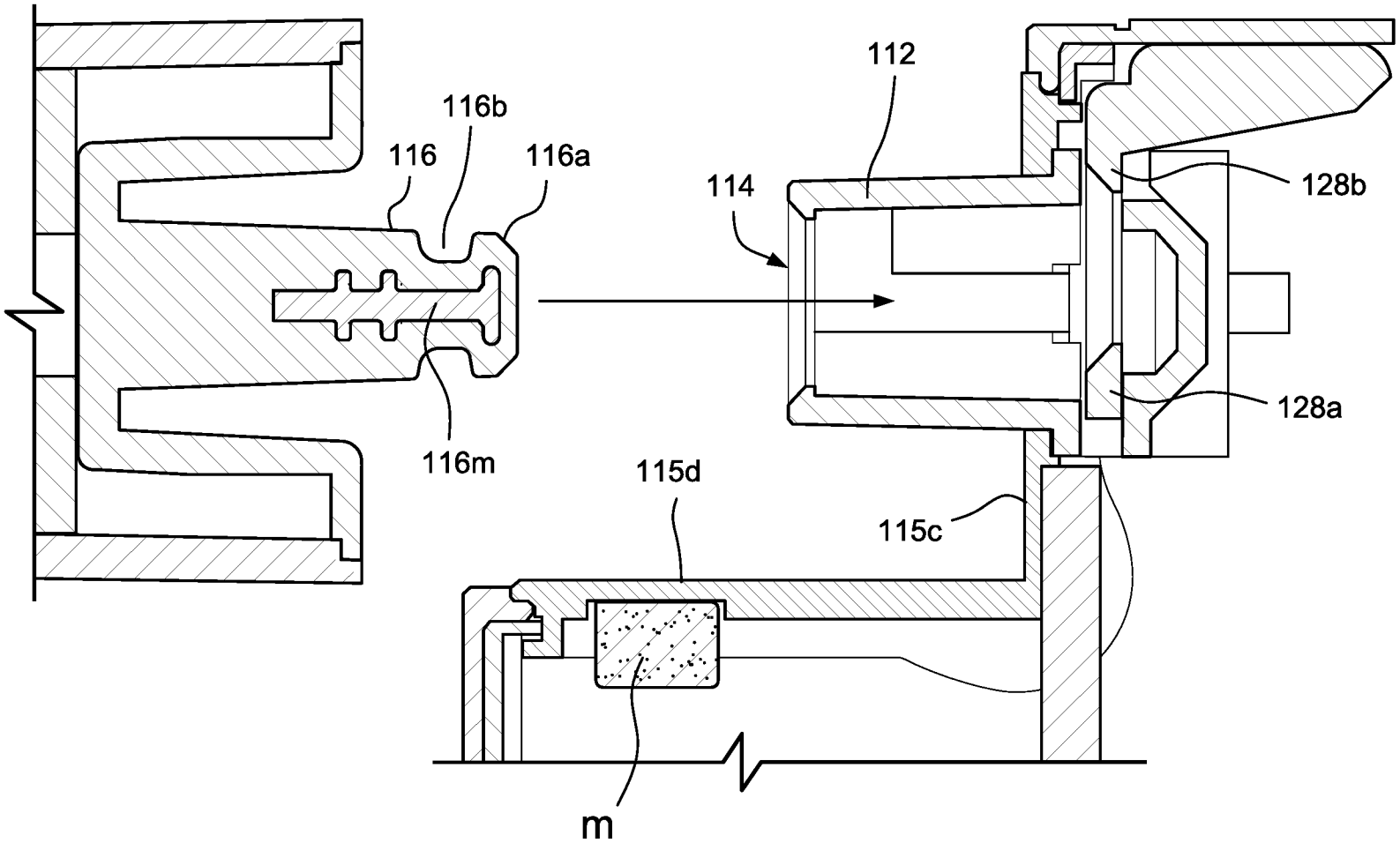
FIG. 7 is an example cross-sectional planar view of a plug connector latching pin latchably mating with an adapter base latching receptacle.

FIG. 7 shows a cross-sectional detail of an example non-limiting latching pin 116 insertable into latching receptacle 114. Latching pin 116 comprises a four-sided shaft (see FIG. 15) with a distal end portion 116*a*. While this shaft is square in cross-section in the embodiment shown, it could have other shapes such as triangular, pentagonal, hexagonal or cylindrical. A circumferential groove 116*b* disposed near the distal end portion 116*a* of the latching pin shaft encircles the end of the shaft. In the example shown, the circumferential groove 116*b* is used to engage with latching fingers 128*a*, 128*b*. Because the groove 116*b* is circumferential and the latching pin 116 is symmetrical, the groove will engage the latching fingers 128*a*, 128*b* irrespective of the angular (rotational) orientation of the latching pin 116 relative to the latching receptacle 114. However, in example embodiments, the latching pin 116 will mate with the latching receptacle 114 only in discrete relative angular position such as for example 0°, 90°, 180° and 270°. Such discrete angular positions give flexibility while simplifying the design and ensuring stability and good connectivity. Other embodiments with a multisided or cylindrical latching pin shaft could provide angular rotation to any desired relative angular orientation so long as some angular rotation orientations provide no contact (a safety feature). One advantage of the flag-shaped conductor approach is that close tolerances are not required to ensure good connections are established.

In the example embodiment, when the electromagnetic latch 128 is in the unlatched state, latching fingers 128*a*, 128*b* are retracted away from a latching position and do not engage the latching pin circumferential groove 116*b*. See FIG. 7. This retracted position of latching fingers 128*a*, 128*b* permits the latching pin 116 to be freely inserted into and removed from latching receptacle 114. In some embodiments, the latching fingers 128*a*, 128*b* are spring biased into engagement positions but retract upon insertion of the latching pin 116 (see angular portions of the latching pin near the distal end) before snapping back into engagement with the latching pin groove 116*b*. The latching fingers 128*a*, 128*b* disengage from latching pin 116 through application of force such as by automatic operation of solenoid armature 129 or, in some embodiments, manual operation of a push button.

Figure 8:
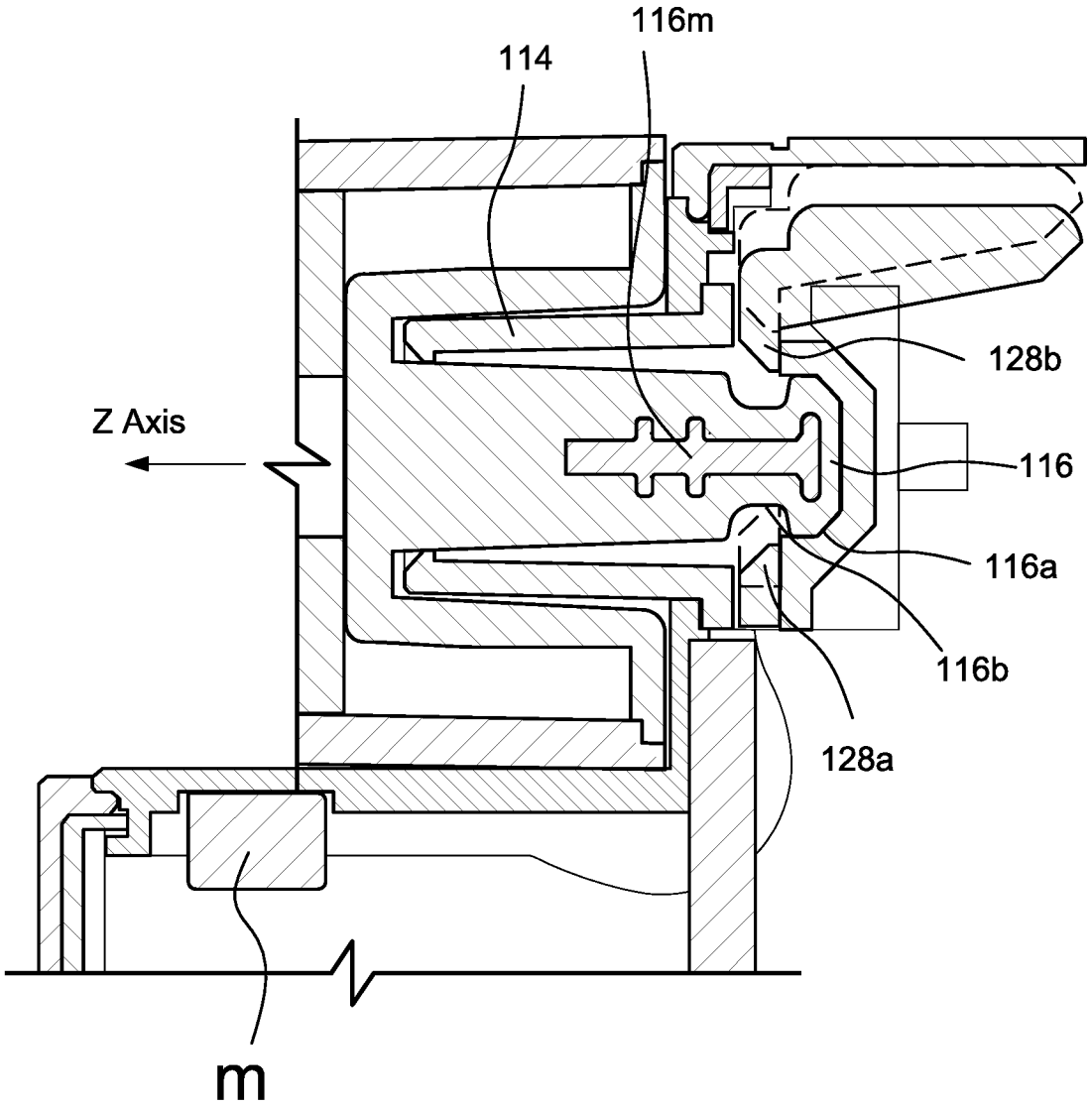
FIG. 8 is an example cross-sectional planar view of a plug connector latching pin latchably mated with the adapter base latching receptacle.
Figure 9:
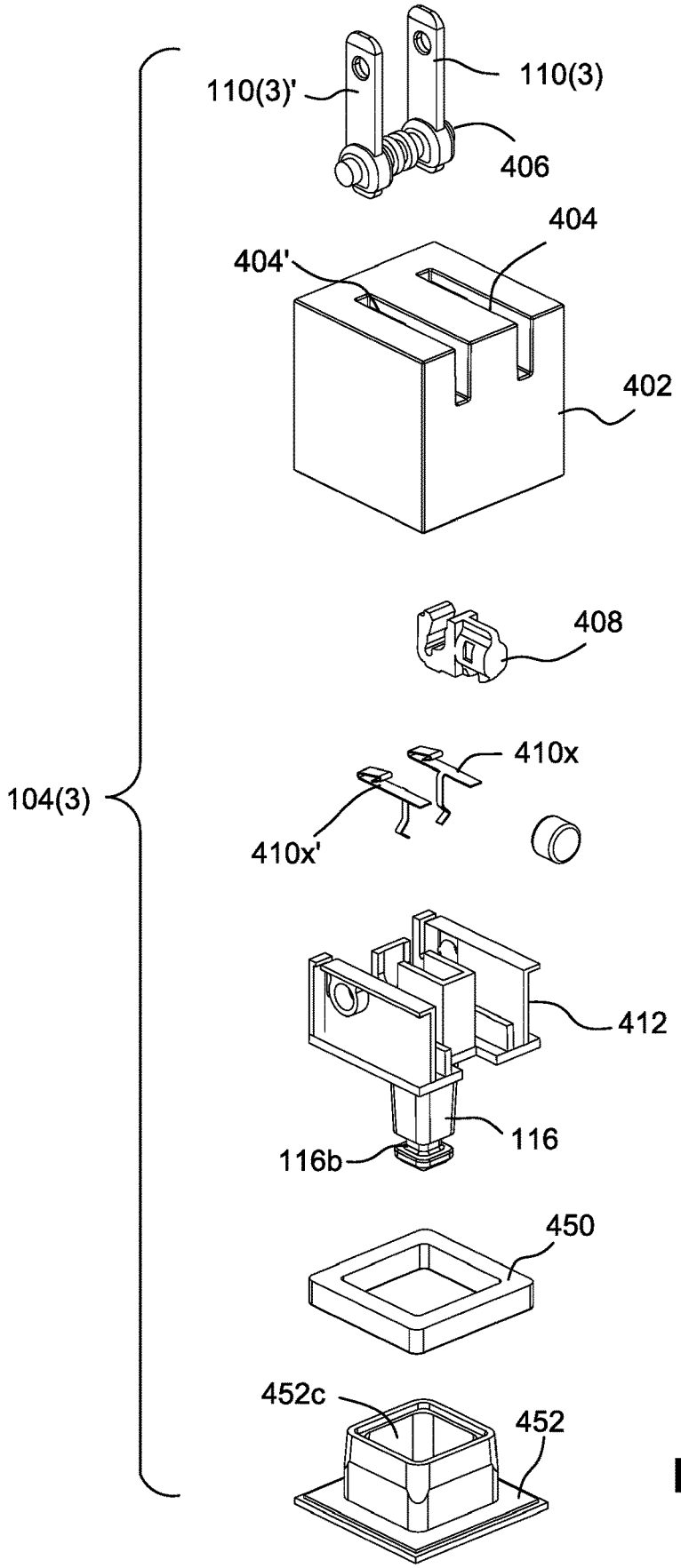
FIG. 9 is an example exploded perspective view of an example non-limiting plug connector.
Figure 10:
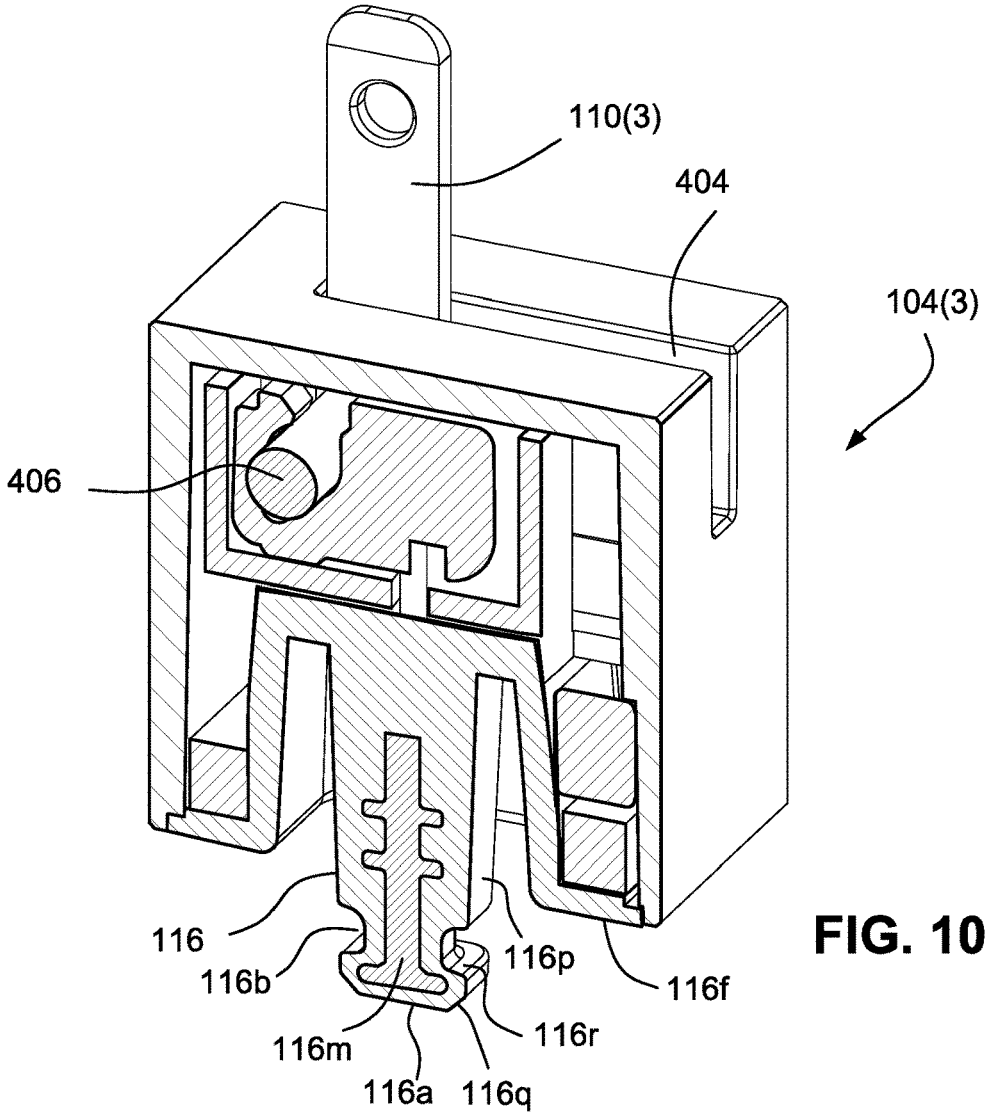
FIG. 10 is an example cross-sectional side elevated perspective view of the FIG. 9 plug connector.
Figure 11:
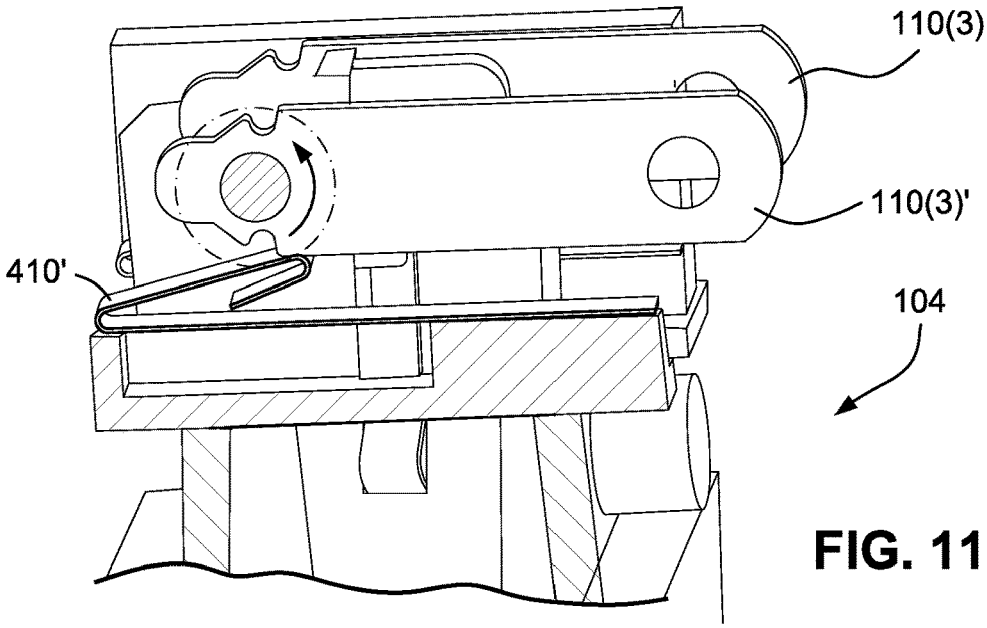
FIG. 11 is an example cross-sectional side elevated perspective view of a portion of the FIG. 9 plug connector showing pivotable terminals engaging with flexible electrical terminals.

However, when the electromagnetic latch 128 is in the latched state (which occurs only when the latching pin 116 is fully inserted into the latching receptacle 114 and conducts power from the power mains 202 into the adapter base 102), latching fingers 128*a*, 128*b* are pushed forward into the circumferential groove 116*b*, thereby engaging the groove and firmly retaining latching pin 116 within latching receptacle 114. See FIG. 8.

Electrical Connectivity Between Latching Pin and Latching Receptacle

FIGS. 6 and 7 also shows electrical connectors 112*z*1, 112*z*2 disposed within the latching receptacle recess 114. In FIG. 7, the electrical connector 112*z*1 is flag-shaped and made of a conductive material such as copper. In the example shown, the flag portion of the connector covers a portion of one inner side wall of the recess and wraps around the inside corner of the recess and extends to cover a portion of an adjacent side wall of the recess. Similarly, as can be seen in FIG. 6A, a second flag-shaped conductor 112*z*2 is disposed on an opposite inner wall of recess 114 and wraps around the opposite inside corner of the recess to cover a portion of a further adjacent inner wall of the recess. In this way, one conductor 112*z*1 covers a portion of two adjacent inner walls of latching receptacle recess 114, and another conductor 112*z*2 covers a portion of the other two adjacent inner walls of the recess. The flag portions of the conductors 112*z*1, 112*z*2 are disposed such that they cannot be contacted by the digits of a human user handling the latching recess 114, and are spaced relative to one another so that creepage will not expose the user to a shock hazard.

Figure 6B:
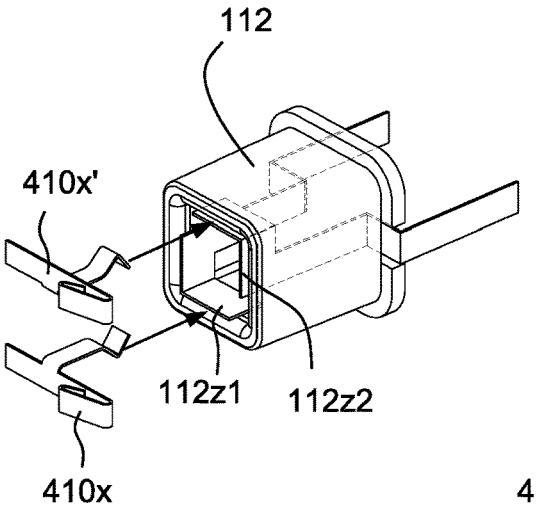
FIG. 6B shows an exploded view of the latching receptacle.
Figure 6C:
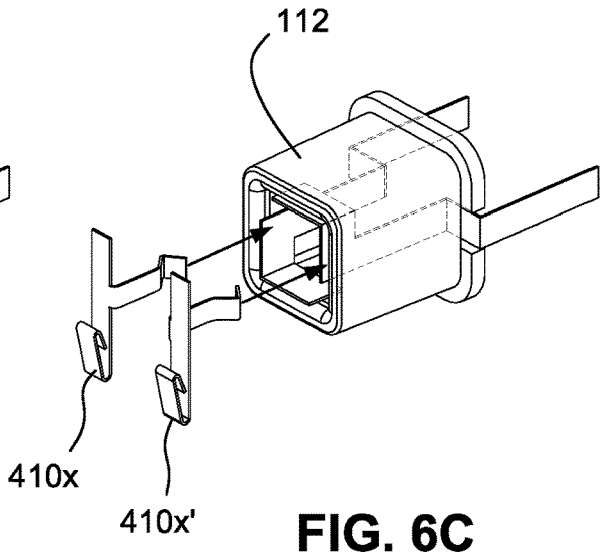
FIG. 6C shows a further exploded view of the latching receptacle.
Figure 12:
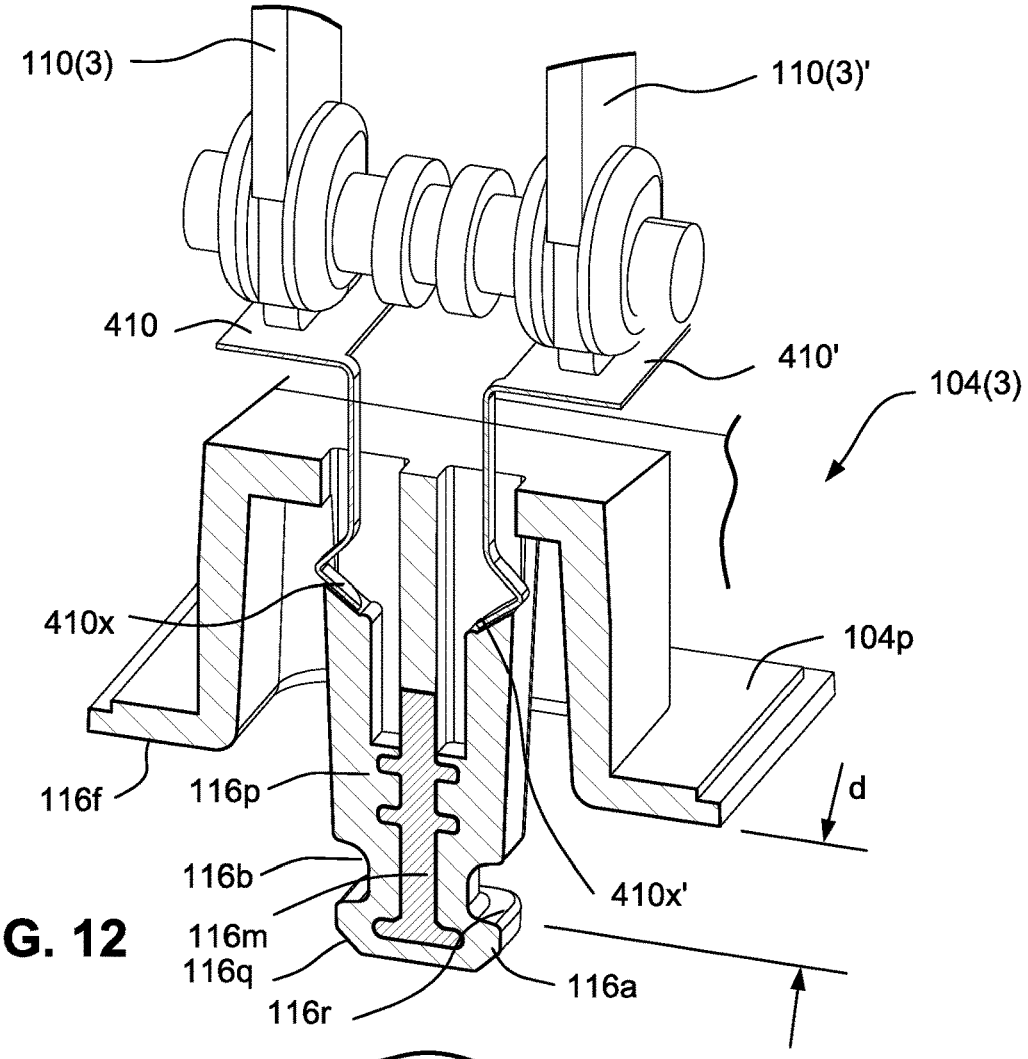
FIG. 12 is an example cross-sectional side elevated perspective view of a plug connector latching pin and its relationship to pivotable power prongs and associated connecting electrical terminals.
Figure 13:
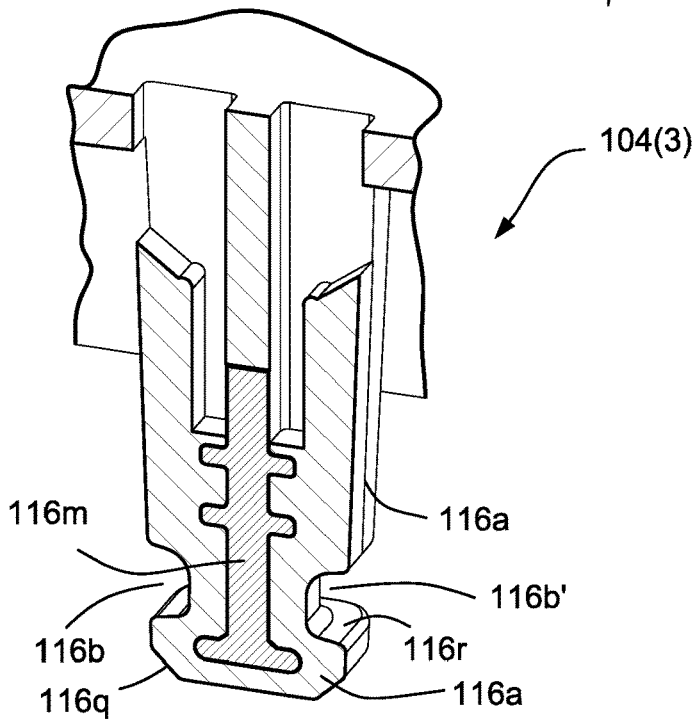
FIG. 13 is an example cross-sectional side elevated perspective view of a molded latching pin with steel reinforcement member.

As can be seen in FIGS. 6B, 6C and 12, the latching pin 116 supports, on opposite sides, two terminals 410, 410' each having angular protruding portions 410*x*, 410*x*'. As the latching pin 116 is inserted into receptacle recess 114, these angular protruding portions 410 deform to fit within the recess and slide into position onto the conductor flags 112*z*1, 112*z*2. One angular protruding portion 410 contacts conductor flag 112*z*1, and the other protruding portion 410' contacts conductor flag 112*z*2 (or vice versa). Because in one non-limiting embodiment the terminals 410, 410' carry alternating current, there is no polarity to worry about and so it does not matter whether angular protruding portion 410 makes contact with conductor flag 112*z*1 or with conductor flag 112*z*2. What is important is that the angular protruding portion 410 contacts one of flags 112*z*1, 112*z*2 and the other angular protruding portion 410' contacts the other one of flags 112*z*1, 112*z*2 without any short circuit or other connection between them. This occurs whenever latching pin 116 is inserted into latching receptacle 114 irrespective of the relative orientation of the latching pin relative to the receptacle—i.e., at an offset of 0°, 90°, 180° or 270°. Any one of these four discrete angular orientations of latching pin 116 relative to receptacle recess 114 will result in excellent connections between the electrical terminals 410 carried by the latching pin and the connection flags 112*z*1, 112*z*2 disposed on the inner walls of the receptacle recess. Thus, good AC electrical connections are made between the latching pin 116 and the latching receptacle 112 for any of four different angular orientations of the latching pin relative to the latching receptacle.

Example Plug Connector Structure

FIGS. 9-14 show example views of a non-limiting plug connector 104(3). The FIG. 9 exploded view details a housing 402 defining slots 404 through which a hinged power prong assembly 406 protrudes. Power prong assembly 406 is pivotable between an extended position and a retracted position. In the extended position, the power prong assembly 406 provides extended prongs 110 that can be inserted into a power socket. In the retracted position, the power prong assembly 406 is mostly disposed within slots 404 but protrudes sufficiently (see FIG. 1) to be manually grasped and pivoted to the extended position.

Figure 14:
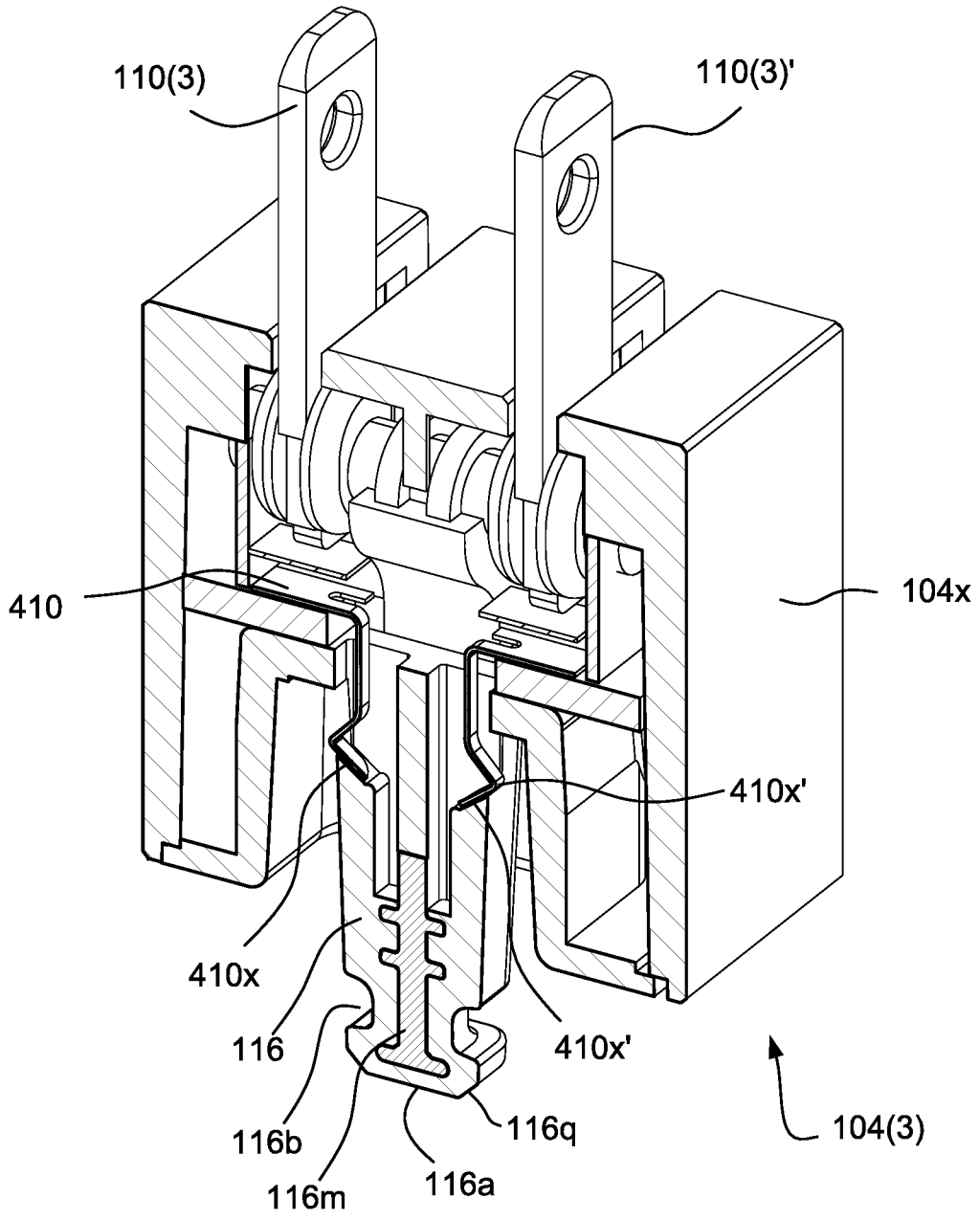
FIG. 14 is similar to FIG. 12 but also shows a plug connector housing.

The plug connector 104(3) further includes a clip 408 and terminals 410. The components 408, 410 are disposed within a latching pin assembly 412 from which latching pin 116 projects. The clip 408 provides a "click" feel when prongs 406 are pivoted to their extended position. The terminals 410 provide electrical connections between the respective prongs 110(3), 110(3)' and electrical conductors within the projecting latching pin 116. The terminals 410 are flexible to smoothly contact with the prongs 406. See also FIG. 10 which shows a detail of how terminal 410 interfaces with and contacts pivoting prong 110(3). FIG. 14 shows a further detail of how the terminals 410 both flexibly contact and are in tension toward prongs 110 and also descend into latching pin 116. Note how the angled out portions 410*x* of terminals 410 extend from the sides of latching pin 116 and can be used to establish a high voltage electrical connection with latching receptacle 114 while still being protected by an insulative housing 104*x* from being contacted by the user handling the plug connector 104.

FIG. 12 further details an internal steel reinforcing pin 116*m* disposed within the center of latching pin 116. The steel reinforcing pin 116*m* or other rigid member is inserted into the tool and co-molded into the latching pin 116 in order to prevent the latching pin from breaking off or bending under abuse. The steel may also be attracted to the magnetic form of permanent magnet M described above to weakly retain the latching pin 116 within the latching receptacle 112.

As shown in FIG. 12, the distance d from the bottom surface 104*p* to the pin/latch contact point is important to control, as is the distance from the top of the adapter face to the pin/latch contact point, in order to provide a solid latching experience. Additionally, as FIG. 10 cross-section shows, the latching pin 116 and the face 116*f* are fabricated as a single part to shorten the pin/latch tolerance loop. In one embodiment, the outer cover will contact only the plastic face of the adapter along a single edge. The bottom face is the only point of contact on all four sides. The cover will not contact the adapter face on three sides (on the other three sides the face controls contact). Locating on both the face and the cover could result in tilt and create a gap. This is why the pin and face are one integral piece, and the bottom face is used to locate. The face is thus used as the datum for contact (Target=PIN/FACE will be USW to the assembly, and is held flush cover to 0.10 proud of the cover lip. The outer frame cover is not the first point of contact—instead the face is the first contact point.

Figure 15:
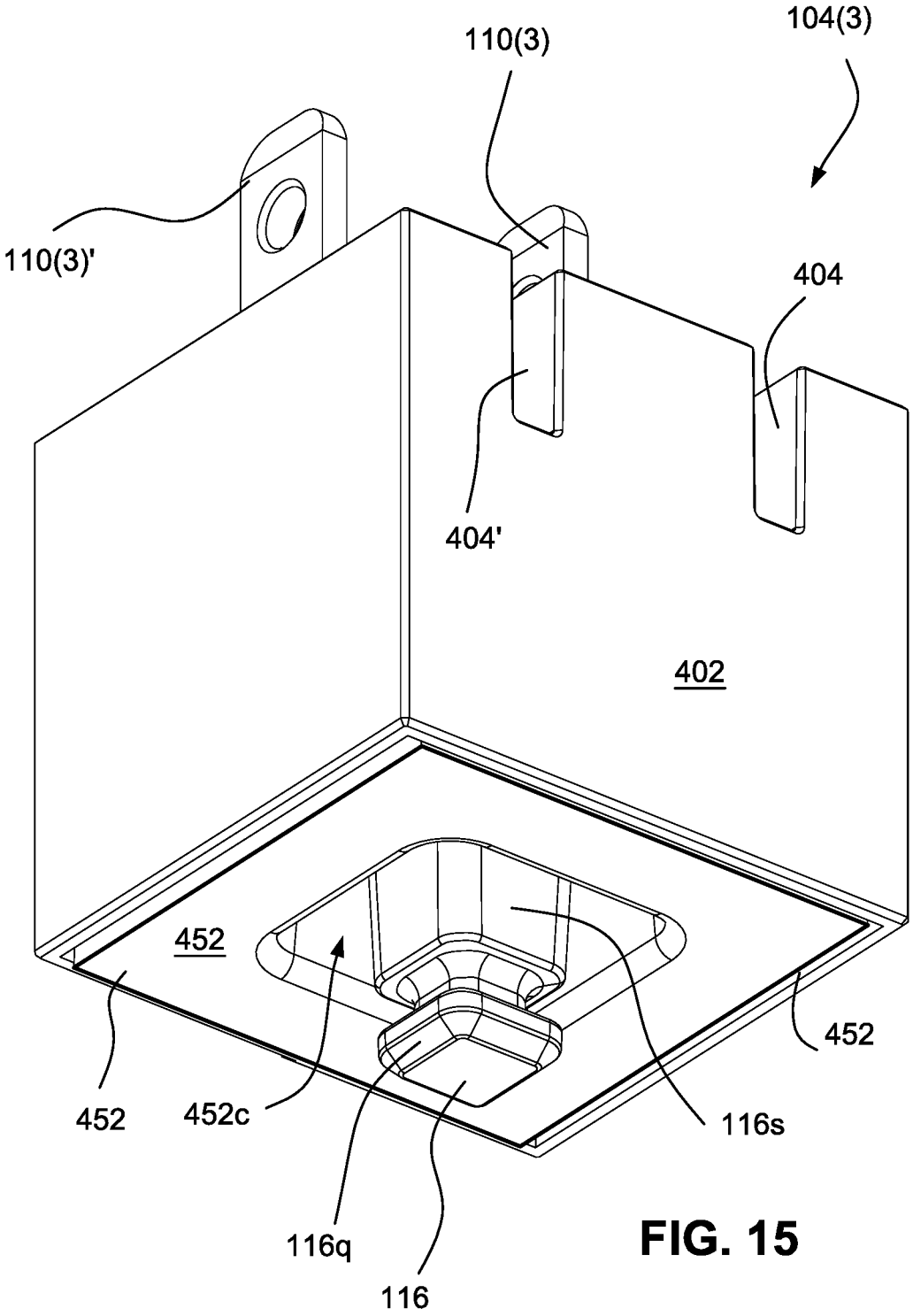
FIG. 15 is an elevated perspective view of the bottom of the FIG. 9 plug connector.

FIG. 15 shows a bottom view of an example plug connector 104. IN the example shown, an outer cover 452 includes an outer cover frame 452*fm* and an outer cover face 452*fc*. The face 452*fc* is, in example embodiments, the datum for contact. Target=pin/face will be USW to the plug connector and is held flush cover to 0.10 proud of the cover lip. The outer cover frame 452*fm* is not used as the first point of contact. This arrangement limits the tolerances that impact the pin<->latch connection.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An interchangeable plug connector comprising:

pivotable electrical prongs configured to insert into electrical sockets;

flexible electrical terminals in contact with said pivotable electrical prongs, the flexible electrical terminals smoothly contacting the pivotable electrical prongs;

a mechanical clip in mechanical contact with the pivotable electrical prongs, the mechanical clip providing a click detent when the electrical prongs are pivoted; and a latching pin that carries at least a part of the flexible electrical terminals, the latching pin configured to be symmetrical about a longitudinal axis to engage a receiver in any of plural different rotational orientations, the latching pin comprising:

a shaft comprising plural planar surfaces defining discrete angular orientations at which the shaft can be inserted into a latching recess, and plural electrical connectors configured to contact corresponding conductors within the latching recess in each of the discrete angular orientations.

2. The plug connector of claim 1 wherein the latching pin comprises a distal end having a circumferential groove for engaging with latching fingers.

3. An interchangeable plug connector comprising:

pivotable electrical prongs configured to insert into electrical sockets;

flexible electrical terminals in contact with said pivotable electrical prongs, the flexible electrical terminals smoothly contacting the pivotable electrical prongs;

a mechanical clip in mechanical contact with the pivotable electrical prongs, the mechanical clip providing a click detent when the electrical prongs are pivoted;

a latching pin that carries at least a part of the flexible electrical terminals, the latching pin configured to be symmetrical about a longitudinal axis to engage a receiver in any of plural different rotational orientations, the latching pin configured to be operably coupled to an electromechanical latch connected to a detection circuit that detects when power is applied and in response to the detection, to control the electromechanical latch to selectively latch said latching pin while power is applied, said detection circuit generating an unlatching magnetic field upon detecting that power is no longer applied that controls the electromechanical latch to unlatch said latching pin.

4. The plug connector of claim 3 wherein:

the detection circuit is electrically isolated from the power and uses a probe to detect when the power is present; and the electromechanical latch is operatively coupled to the detection circuit, the electromechanical latch magnetically latching to move the latching pin to and hold the latching pin at a retaining position when the detection circuit detects the power is present, and magnetically unlatching to disengage the latching pin from the retaining position when the detection circuit detects that the power is no longer present.

5. The plug connector of claim 4 wherein the detection circuit comprises a retriggerable one-shot timer having a time constant that exceeds a periodicity of the power.

6. The plug connector of claim 3 wherein the detection circuit comprises a capacitor connected in series with a solenoid, the capacitor discharging through the solenoid, the solenoid generating a magnetic field that unlatches the electromechanical latch when the detection circuit detects that the power is no longer present.

7. The plug connector of claim 3 wherein the latching pin is insertably engageable with the electromechanical latch and comprises an internal rigid member, the electromechanical latch mechanically engaging with the latching pin.

8. The plug connector of claim 3 wherein the latching pin has a circumferential groove that the electromechanical latch-selectively engages with.

9. The plug connector of claim 8 wherein the insertable latching pin includes the flexible terminals which electrically and mechanically engage the pivotable electrical prongs.

10. A plug connector comprising:

pivotable electrical prongs configured to insert into electrical sockets;

flexible electrical terminals in contact with said pivotable electrical prongs, the flexible electrical terminals contacting the pivotable electrical prongs;

a mechanical clip in mechanical contact with the pivotable electrical prongs, the mechanical clip providing a click detent when the electrical prongs are pivoted; and a latching pin that carries at least a part of the flexible electrical terminals, the latching pin configured to be symmetrical about a longitudinal axis to engage an electromechanical latching receiver in any of plural different rotational orientations.

11. A plug connector comprising:

pivotable electrical prongs, a mechanical clip in mechanical contact with the pivotable electrical prongs, the mechanical clip providing a click detent when the electrical prongs are pivoted, and a latching pin that carries flexible electrical terminals, the latching pin configured to be symmetrical about a longitudinal axis to engage an electromechanical latching receiver in any of plural different rotational orientations.

* * * * *